US007842624B2

(12) United States Patent
Hennige et al.

(10) Patent No.: US 7,842,624 B2
(45) Date of Patent: Nov. 30, 2010

(54) TEXTILE SUBSTRATES HAVING SELF-CLEANING PROPERTIES

(75) Inventors: Volker Hennige, Dülmen (DE); Christian Hying, Rhede (DE); Gerhard Hörpel, Nottuln (DE); Markus Oles, Hattingen (DE); Edwin Nun, Billerbeck (DE); Bernhard Schleich, Recklinghausen (DE)

(73) Assignee: Evonik Degussa GmbH, Essen (DE)

( * ) Notice: Subject to any disclaimer, the term of this patent is extended or adjusted under 35 U.S.C. 154(b) by 528 days.

(21) Appl. No.: 11/312,340

(22) Filed: Dec. 21, 2005

(65) Prior Publication Data

US 2006/0172641 A1 Aug. 3, 2006

(30) Foreign Application Priority Data

Dec. 27, 2004 (DE) ..... 10 2004 062 742

(51) Int. Cl.
*B32B 5/14* (2006.01)

(52) U.S. Cl. ..... 442/75; 442/59; 442/64

(58) Field of Classification Search ..... 442/59, 442/64, 75

See application file for complete search history.

(56) References Cited

U.S. PATENT DOCUMENTS

| | | | | |
|---|---|---|---|---|
| 5,849,942 | A * | 12/1998 | Standke et al. | 556/424 |
| 6,811,856 | B2 | 11/2004 | Nun et al. | |
| 6,852,389 | B2 | 2/2005 | Nun et al. | |
| 6,858,284 | B2 | 2/2005 | Nun et al. | |
| 6,977,094 | B2 | 12/2005 | Oles et al. | |
| 2002/0016433 | A1* | 2/2002 | Keller et al. | 528/10 |
| 2002/0150723 | A1 | 10/2002 | Oles et al. | |
| 2002/0192385 | A1 | 12/2002 | Jenkner et al. | |
| 2003/0013795 | A1 | 1/2003 | Nun et al. | |
| 2003/0049396 | A1 | 3/2003 | Oles et al. | |
| 2003/0147932 | A1 | 8/2003 | Nun et al. | |
| 2004/0154106 | A1 | 8/2004 | Oles et al. | |
| 2005/0084653 | A1 | 4/2005 | Nun et al. | |
| 2005/0103457 | A1 | 5/2005 | Nun et al. | |
| 2005/0112326 | A1 | 5/2005 | Nun et al. | |

(Continued)

FOREIGN PATENT DOCUMENTS

| | | |
|---|---|---|
| DE | 102 08 280 A1 | 9/2003 |

(Continued)

OTHER PUBLICATIONS

Machine translation of WO 2004/048450, Jun. 10, 2004, 12 pages total.*

(Continued)

*Primary Examiner*—D. Lawrence Tarazano
*Assistant Examiner*—Peter Y Choi
(74) *Attorney, Agent, or Firm*—Oblon, Spivak, McClelland, Maier & Neustadt, L.L.P.

(57) ABSTRACT

The present invention relates to a vapor-pervious water-impervious substrate, preferably a fibrous nonwoven web, which can be used in particular as a textile continuous sheet material, for example as an awning or as an inlet in apparel. The substrate according to the present invention may have self-cleaning properties. The substrate according to the present invention is simple to produce in an at least two-step process wherein a coating on the fibers of the substrate is produced in the first step and then hydrophobic particles are applied to the coated fibers by means of an adhesion promoter.

33 Claims, 2 Drawing Sheets

U.S. PATENT DOCUMENTS

| | | | | |
|---|---|---|---|---|
| 2005/0118433 | A1 | 6/2005 | Oles et al. | |
| 2005/0163951 | A1 | 7/2005 | Oles et al. | |
| 2005/0167877 | A1 | 8/2005 | Nun et al. | |
| 2005/0205830 | A1 | 9/2005 | Oles et al. | |
| 2005/0208269 | A1 | 9/2005 | Nun et al. | |
| 2005/0227045 | A1 | 10/2005 | Oles et al. | |
| 2006/0222815 | A1 * | 10/2006 | Oles et al. | 428/145 |
| 2008/0020190 | A1 | 1/2008 | Nun et al. | |

FOREIGN PATENT DOCUMENTS

| | | | |
|---|---|---|---|
| WO | WO9604123 | * | 2/1996 |
| WO | WO 2004/048450 A1 | | 6/2004 |
| WO | WO 2004/101880 A1 | | 11/2004 |

OTHER PUBLICATIONS

Translation of WO 2004/048450 to Gutsch (39 pages total).*
U.S. Appl. No. 10/556,092, filed Nov. 9, 2005, Oles, et al.
U.S. Appl. No. 10/526,559, filed Mar. 4, 2005, Nun, et al.
U.S. Appl. No. 11/312,469, filed Dec. 21, 2005, Nun, et al.
U.S. Appl. No. 10/546,979, filed Aug. 26, 2005, Nun, et al.
U.S. Appl. No. 11/321,285, filed Dec. 21, 2005, Oles, et al.
U.S. Appl. No. 11/312,557, filed Dec. 21, 2005, Oles, et al.
U.S. Appl. No. 10/111,407, filed May 6, 2002, Oles, et al.
U.S. Appl. No. 10/527,641, filed Mar. 14, 2005, Nun, et al.
U.S. Appl. No. 09/241,077, filed Feb. 1, 1999, Peters, et al.

* cited by examiner

TEXTILE SUBSTRATES HAVING SELF-CLEANING PROPERTIES

CROSS REFERENCES TO RELATED APPLICATIONS

This application claims priority to German Patent No. 102004062742.8, filed on Dec. 27, 2004, which is incorporated herein by reference in its entirety.

BACKGROUND OF THE INVENTION

1. Field of the Invention

The present invention relates to textile substrates, in particular fibrous nonwoven webs, which exhibit self-cleaning properties, i.e., the so-called lotus effect.

2. Discussion of the Background

There is wide industrial interest in making and using self-cleaning surfaces for a variety of applications. For instance, textiles comprising Teflon® (Gortex®) have the desirable properties of being pervious to water vapor (perspiration) but impervious to liquid water (rain). Textiles, in particular sports and work wear composed of such materials, are now widely used. However, and importantly, mere hydrophobicization of surfaces does not provide surfaces with self-cleaning properties (lotusing).

The principle of self-cleaning surfaces was pioneered in nature by the lotus plant. For a surface to be efficiently self-cleaning it has to have a certain roughness as well as being very hydrophobic. A suitable combination of structure and hydrophobicity ensures that even small amounts of moving water will entrain soil particles adhering to the surface and clean the surface (WO 96/04123).

EP 0 933 388 discloses that self-cleaning surfaces require an aspect ratio of >1 and a surface energy of less than 20 mN/m. Aspect ratio is here defined as the ratio of the height of the structure to its width. The aforementioned criteria are actualized in nature, for example, in the lotus leaf. The surface of the plant, formed from a hydrophobic waxy material, has elevations which are spaced apart by a few μm. Water droplets essentially contact only these peaks. EP 0 909 747 teaches a process for producing a self-cleaning surface.

Production of a self-cleaning surface begins with a surface having hydrophobic elevations 5 to 200 μm high. A dispersion of powder particles and an inert material dispersed in a siloxane solution is applied to the surface. The treated surface is then subsequently cured, thereby resulting in structure-forming particles being immobilized on the surface by an auxiliary medium to form a self-cleaning surface.

WO 00/58410 concludes that it is technically possible to make surfaces of articles artificially self-cleaning. The surface structures necessary for this are composed of elevations and depressions, have a distance in the range from 0.1 to 200 μm between the elevations of the surface structures, and have an elevation height in the range from 0.1 to 100 μm. The materials used for this purpose must consist of hydrophobic polymers or durably hydrophobicized material.

Numerous patent applications are concerned with endowing surfaces with self-cleaning properties. To endow surfaces with self-cleaning properties, particles are frequently applied to the surfaces by means of adhesives. Such processes are utterly unsuitable for finishing textiles, since their flexibility and perviousness to water vapor is lost in the process.

DE 101 18 348 describes polymeric fibers having self-cleaning surfaces wherein the self-cleaning surface is retained by the action of a solvent comprising structure-forming particles, incipiently dissolving the surface of the polymeric fibers by the solvent, adhering the structure-forming particles to the incipiently dissolved surface and removing the solvent. The disadvantage with this process is that processing the resulting polymeric fibers by spinning, knitting, etc may cause the structure-forming particles, and hence the structure responsible for the self-cleaning surface, to become damaged or even completely lost. Should this happen, the self-cleaning effect would be lost as well.

DE 101 18 346 describes textile fabrics having a self-cleaning and water-repellent surface, constructed from at least one synthetic and/or natural textile base material A and an artificial, at least partly hydrophobic surface. The artificial, at least partially hydrophobic surface has both elevations and depressions and comprises particles securely bonded to the base material A without adhesives, resins or lacquers. The textile fabrics having a self-cleaning and water-repellant surface are obtained by treating the base material A with at least one solvent containing particles in undissolved form and subsequently removing the at least one solvent to leave at least a portion of the particles securely bonded to the surface of the base material A.

The last two above-cited processes have the disadvantage that, to obtain secure fixing of the particles to the textile substrates, the particles have to be incorporated in the surfaces of the substrates (or fibers) and this treatment has a deleterious effect on the properties of the substrates (or the fibers).

DE 102 05 007 attempts to overcome this disadvantage by providing for particles suspended in an alcohol to be sprayed onto textile substrates. The alcohol is then subsequently removed. This process avoids damage to the fibers or substrate. Durable fixing of the particles is not possible, however. Thus, while a load generated by falling raindrops is tolerated by the coating, a mechanical load such as scuffing or the like is not.

Thus, known methods of making vapor-pervious, water impervious, and/or self-cleaning substrates, textiles, and fabrics are not satisfactory because the methods weaken the substrates, textiles, and fabrics; render the substrates, textiles, and fabrics incapable of mechanical processing; render the substrates, textiles, and fabrics incapable of remaining intact when put under a load or exposed to mechanical forces, or are complicated and difficult to practice.

SUMMARY OF THE INVENTION

It is an object of the present invention to provide a simple process for producing vapor-pervious, water-impervious textile substrates in two or more steps, characterized in that in step a) a substrate is treated with a liquid comprising at least an adhesion promoter and the treated substrate is then subsequently dried, and in step b) the substrate treated according to a) is treated with a mixture comprising hydrophobic particles having an average particle size in the range from 0.02 to 100 μm in diameter, a solvent and at least one adhesion promoter. The thus treated substrate is then subsequently dried.

It is another object of the present invention to provide a vapor-pervious, water-impervious, textile substrate, preferably produced according to the process of the present invention, the substrate being characterized in that the substrate comprises fibers, and on the surface of the fibers a coating comprising at least one compound comprising oxygen, silicon and hydrophobic particles having an average particle size in the range from 0.02 to 100 μm.

Another object of the present invention is to provide industrial textiles, textile continuous sheet materials, and clothing textiles that are vapor pervious, water impervious, and self-cleaning. Since the substrates of the present invention have self-cleaning properties, they are particularly useful for producing articles exposed to high levels of dirt and water.

A further object of the present invention is to provide substrates that exhibit a high abrasion stability and have excellent self-cleaning properties due to moving water.

Another object of the present invention is to provide a process for producing the above-described materials that can be practiced on commercially available machines used for coating substrates with ceramic. An example of such a machine is described in WO 99/16260.

These and other objects, which will become apparent during the following detailed description, have been achieved by the inventors' discovery that vapor-pervious, water-impervious textile substrates are very simple to produce and endow with self-cleaning properties by endowing a textile substrate in a first step with an adhesion promoter and, in a second step, the substrate thus pretreated is treated with a mixture which comprises a further adhesion promoter and also hydrophobic particles having an average particle size in the range from 0.02 to 100 μm. The twofold use of suitable adhesion promoters achieves secure attachment of the hydrophobic particles to the textile substrates.

It is believed that the first treatment with an adhesion promoter endows the surface of the fibers of the substrate with free hydroxyl groups. The free hydroxyl groups are bound to the fibers via silicon atoms. Silanol groups of the second adhesion promoter, which is itself attached to the hydrophobic particles, then become chemically attached to the free hydroxyl groups in the second treatment step.

BRIEF DESCRIPTION OF THE DRAWINGS

A more complete appreciation of the invention and many of the attendant advantages thereof will be readily obtained as the same become better understood by the reference to the following detailed description when considered in connection with the accompanying drawings, wherein.

DETAILED DESCRIPTION OF THE PREFERRED EMBODIMENTS

DEFINITIONS

Figure 1:
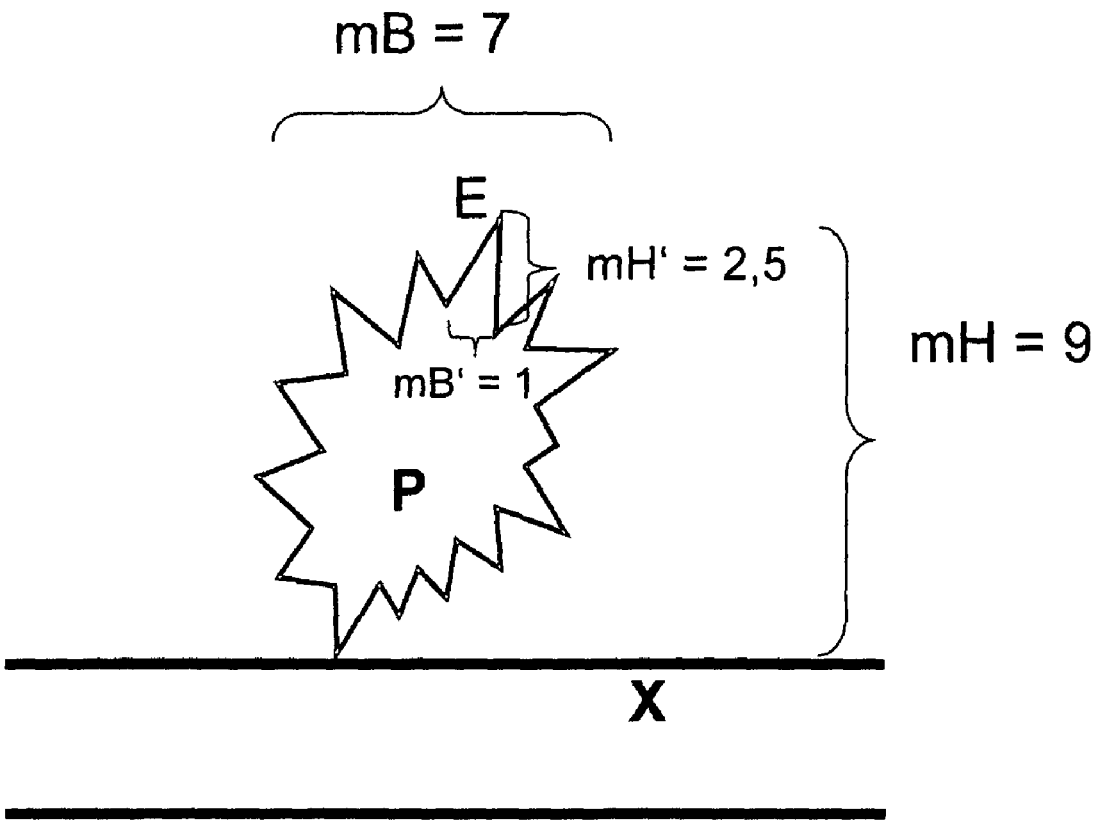
FIG. 1 is a schematic illustration of the difference between elevations formed by particles and elevations formed by the fine structure.
Figure 2:
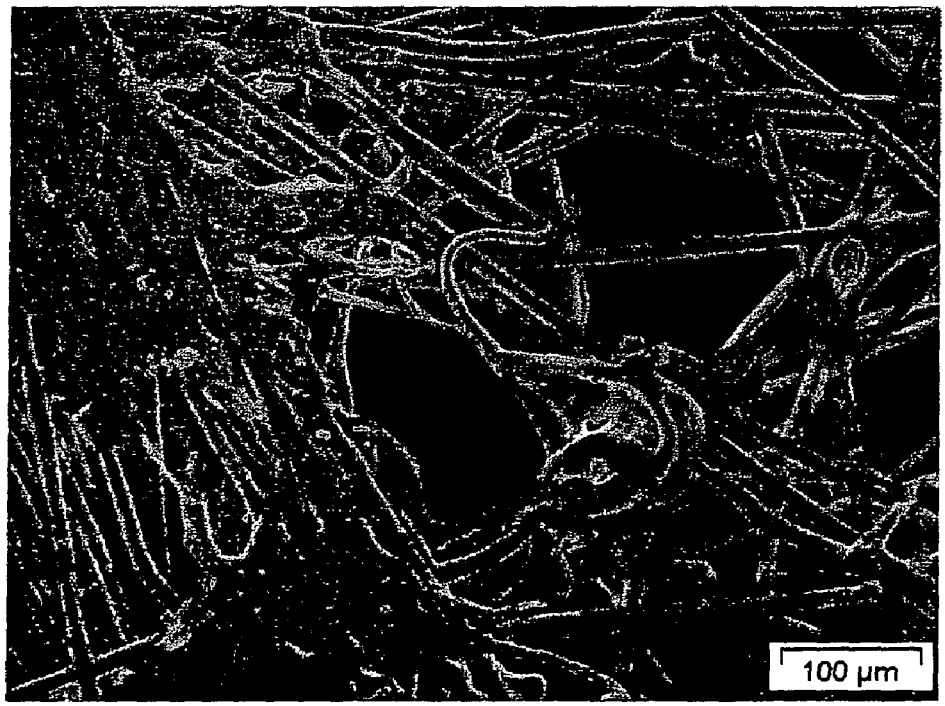
FIGS. 2, 3 and 4 show scanning electron micrographs of substrates at different magnifications. The elevations and depressions present as a result of the fibers being coated with particles are very distinctly visible in FIG. 4.
Figure 3:
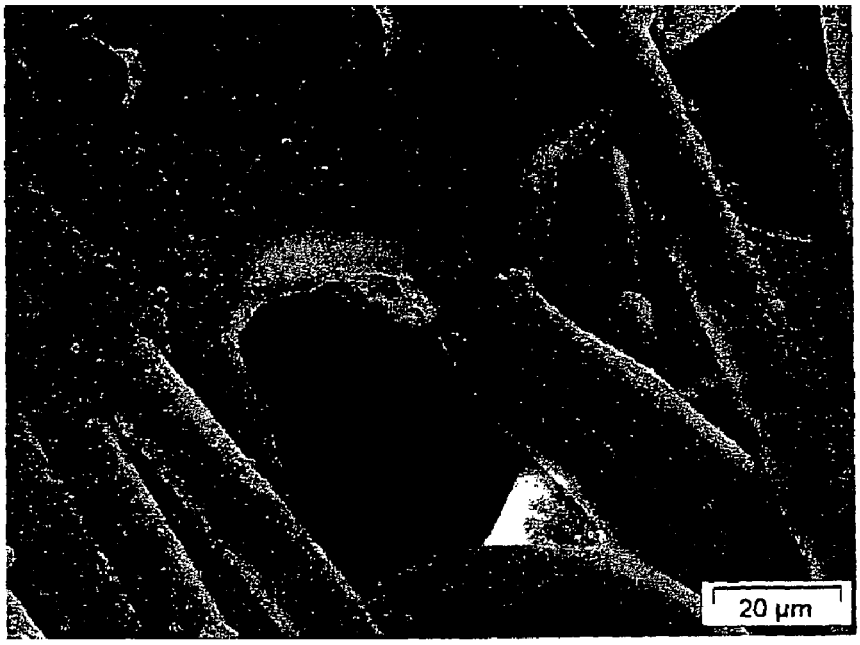
Figure 4:
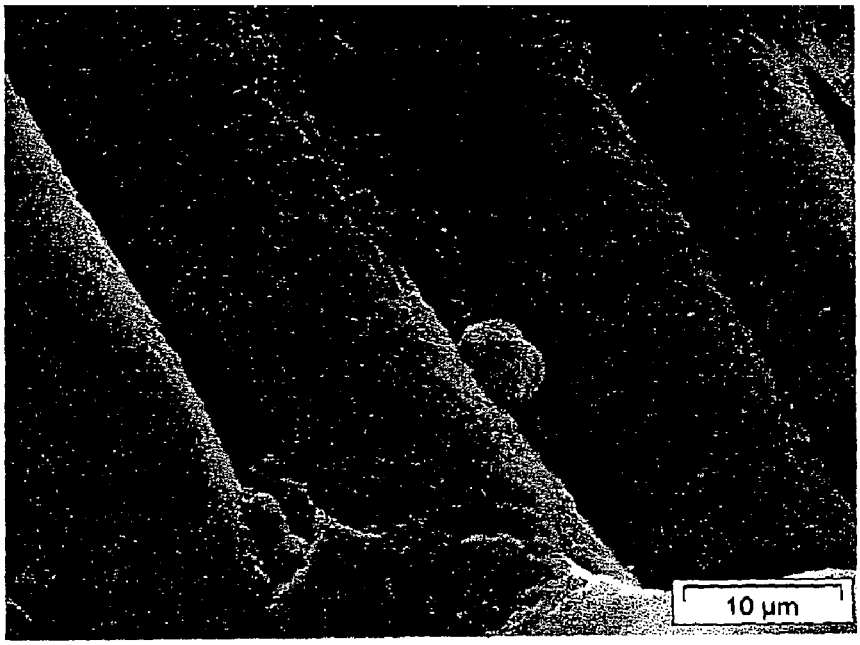

The textile substrates of the present invention are vapor pervious and water impervious. The term "vapor pervious" is to be understood as meaning that the textile substrates are pervious to water vapor and other gases.

The term "water impervious" is understood as meaning the textile substrates are impervious to water at atmospheric pressure; that is, they are able to support a water column. The substrates may be pervious to other liquids, in particular less hydrophilic liquids such as alcohols or hydrocarbons. It will be appreciated that the textiles of the present invention also become pervious to water once the water column has reached a certain height, i.e., they will also become pervious to water at a certain pressure.

The term "fine structure" is to be understood as referring to structures on a surface having heights, widths and spacings in the nanometer region comprising elevations spaced apart from 1 to 1000 nm on average and from 1 to 1000 nm high on average.

The term "aspect ratio of a particle or elevation of a particle" is defined as the ratio of the maximum height to the maximum width of the particle or elevation of a particle.

The term "average spacing of the elevations" refers to the distance from the highest elevation of an elevation to the highest elevation of the next elevation.

The term "self-cleaning properties" is defined as substrates of the present invention having a rolloff angle, measured as per Example 11 on a water droplet 60 μl in volume, of less than 20° and preferably less than 10°. The term "wetting" is defined as an applied water droplet (20 μl) spreading on the surface of a tested substrate.

The present invention's relates to a process for producing a vapor-pervious water-impervious textile substrate in two or more steps, wherein in step a) a substrate is treated with a liquid comprising at least an adhesion promoter and then subsequently dried, and in a step b) the substrate treated according to a) is treated with a mixture comprising hydrophobic particles having an average particle size in the range from 0.02 to 100 μm, at least one alcohol, and at least one adhesion promoter and then subsequently dried.

The liquid employed in step a) can be water, some other solvent, for example, alcohol(s), ether(s), ester(s), ketone(s), aldehyde(s), N-methylpyrrolidone or the like, or a mixture of water and one or more solvents. Particular preference is given to employing alcohols, and most particular preference is given to employing ethanol. The liquid employed in step a) is preferably a solution or sol which in either case comprises from 0.1% to 10% by weight of a hydrolyzed silane adhesion promoter. When a silane adhesion promoter is used in non-hydrolyzed form, the mixture has to be additionally admixed with an amount of water sufficient to hydrolyze the silane and a mineral acid, which acts as a catalyst for hydrolysis. As well as the adhesion promoter, the liquid employed may further comprise from 0.1% to 10% by weight, and preferably from 1% to 5% by weight, of tetraethoxysilane (TEOS). The additional employment of TEOS makes it possible to achieve better bonding of the second coating on the substrate.

The adhesion promoter used in step a) is preferably 3-aminopropyl-triethoxysilane (AMEO), 2-aminoethyl-3-aminopropyltrimethoxysilane, 3-glycidyloxytrimethoxysilane (GLYMO), 3-methacryloxypropyltrimethoxysilane (MEMO, Silfin®, vinyltriethoxysilane (VTEO), vinyltrimethoxysilane and/or vinyltris(2-methoxyethoxy)silane. Suitable silanes are available, for example, from Degussa AG.

The mixture employed in step b) is preferably a mixture which comprises a dispersion of from 0.1% to 5% by weight of hydrophobic particles in a solvent. Preferably, the mixture comprises an acidified solvent that comprises from 0.1% to 20% by weight of at least one acid, preferably a mineral acid (fraction based on particle fraction), preferably an aqueous acid in an amount of from 2.5% to 7.5% and preferably 5%, by weight. Preferably, the mineral acid is hydrochloric acid. Additionally, the mixture comprises from 0.1% to 20% by weight, preferably from 1% to 10% by weight, based on particle fraction, of at least one adhesion promoter. The adhesion promoters used in step b) are preferably trimethylethoxysilane, isobutyltriethoxysilane and/or octyltriethoxysilane. In a preferred embodiment, TEOS is admixed to the mixture as a further silane. Useful solvents include inter alia alcohol, ethers, esters, ketones, aldehydes, N-methylpyrrolidone or the like, of which alcohols are preferably used and ethanol is most preferably used.

The hydrophobic particles used in the dispersion are preferably selected from hydrophobic particles of silicates, minerals, metal oxides, metal powders, precipitated and/or pyrogenic silicas, pigments, polymers, or a combination thereof. Silicas are particularly preferred for use as hydrophobic particles.

Preference is given to the use of particles having an average particle diameter in the range from 0.05 to 50 μm and most preferably in the range from 0.1 to 30 μm. But it is also possible to use particles which combine from primary fragments to form agglomerates or aggregates having a particle size in the range from 0.2 to 100 μm.

It may be advantageous that the particles used have a structured surface. It is preferable to use particles having an irregular fine structure in the nanometer region comprising elevations spaced apart from 1 to 1000 nm on average and from 1 to 1000 μm high on average, preferably in each case from 2 to 750 nm and most preferably in each case from 10 to 100 nm on the surface. Fine structure is to be understood as referring to structures having heights, widths and spacings in the ranges mentioned. Such particles preferably comprise at least one compound selected from pyrogenic silica, precipitated silicas, aluminum oxide, silicon dioxide, pyrogenic and/or doped silicates or pulverulent high-temperature-resistant polymers. The particles having the irregular, aerially fissured fine structure in the nanometer region preferably have elevations having an aspect ratio in the fine structures of greater than 1 and more preferably greater than 1.5. Aspect ratio here is defined as the ratio of the maximum height to the maximum width of the elevation. FIG. 1 provides a schematic illustration of the difference between the elevations formed by the particles and the elevations formed by the fine structure. The figure shows the surface of a substrate X comprising particles P (although only one particle is depicted for simplicity). A selected elevation of the elevations E, which are present on the particles due to the fine structure of the particles, has an aspect ratio of 2.5, reckoned as ratio of the maximum height of the elevation mH', which is 2.5, to the maximum width mB', which is 1.

The hydrophobic properties of the particles may be inherent to the material used for the particles, as in the case of, for example, polytetrafluoroethylene (PTFE). It is also possible to use hydrophobic particles which, following a suitable treatment, acquire hydrophobic properties. For example, to acquire hydrophobic properties, particles may be treated with at least one compound selected from fluoroalkylsilanes, alkylsilanes, perfluoroalkylsilanes, paraffins, waxes, fatty acid esters, functionalized long-chain alkanes and alkyldisilazanes. Useful particles include, in particular, hydrophobicized pyrogenic silicas, known as aerosils. Examples of hydrophobic particles are Aerosil® VPR 411, Aerosil® R202, Aerosil® VPLE 8241 or Aerosil® R 8200. Examples of particles hydrophobicizable by treatment with perfluoroalkylsilane and subsequent heat treatment are Aeroperl 90/30, Sipemat silica 350, Alumina C, vanadium-doped zirconium silicate or Aeroperl P 25/20. There is usually no problem with employing such hydrophobicized particles up to a temperature of 350° C. in that their hydrophobicity, when this temperature limitation is observed, is not substantially impaired.

An alcohol may be preferably used as solvent in the steps a) and/or b). Preference is given to using, for example, ethanol, isopropanol or methanol. It is more preferable to use ethanol as the alcohol.

The treating of the substrate with a liquid according to step a) and/or the treating of the substrate from step a) according to step b) with the mixture, is effected by knife coating, spray coating or roller coating the liquid or mixture onto the substrate or by drenching the substrate with the liquid or mixture or by dipping the substrate into the liquid or mixture. Preferably, the substrate is dipped into the liquid in the first step and drenched with the mixture in the subsequent step b).

The drying according to steps a) and/or b) is preferably effected by heating the treated substrate to a temperature in the range from 80 to 250° C., preferably in the range from 115 to 180° C. and most preferably to a temperature in the range from 120 to 160° C. The temperature in question has to be chosen so that the polymeric material of the substrate does not deform, melt or decompose.

The textile substrate used is preferably a woven fabric, a loop-formingly knit fabric, a felt or a fibrous nonwoven web composed of fibers, in particular polymeric fibers. The polymeric fibers are preferably composed of polyester, polyamide, polyolefin, natural fibers, or a combination thereof. It is also possible to use fibrous nonwoven webs composed of blend fibers.

It may be advantageous for the surfaces which have been endowed with the surface structure to be subsequently hydrophobicized (again). This can be effected by treating the surfaces with the compounds indicated for hydrophobicizing the particles.

One way to carry out the process of the present invention, when a sheetlike, flexible substrate is used as starting material, is, for example, for the substrate to be unwound off a reel and led at a speed in the range from 1 m/h to 10 m/s, preferably a speed in the range from 0.5 m/min to 50 m/min, and most preferably at a speed in the range from 2 m/min to 10 m/min, through at least one apparatus which applies the liquid to one or both of the sides of the substrate. The at least one apparatus may be, for example a roll, a spraying apparatus, a knife coater or a dip tank. At least one further apparatus is used to dry, by heating, the substrate thus treated. The at least one further apparatus can be, for example, an electrically heated oven. The substrate thus treated can either be wound up again and treated in a second pass through above-described apparati, this time substituting for the liquid the mixture of step b). Alternatively, the substrate treated according to step a) passes directly through at least one different apparatus which can be constructed like the apparatus carrying out step a) which applies the mixture to one or both of the sides of the substrate, for example a roll, a spraying apparatus, a knife coater or a dip tank where the substrate is drenched therein, and at least a further different apparatus whereby drying of the substrate thus treated is made possible by heating. The further different apparatus could be, for example, an electrically heated oven. The substrate thus produced can then be wound up on a second reel. This makes it possible to produce the substrate of the present invention in a continuous process. Similarly, any necessary after treatment steps (a subsequent hydrophobicization for example) can likewise be carried out in a continuous process.

The process of the present invention makes it possible to produce the present invention's vapor-pervious water-impervious textile substrate which is characterized in that the substrate comprises on the surface of the fibers a first coating comprising at least one compound comprising oxygen and silicon and on this coating hydrophobic particles having an average particle size in the range from 0.02 to 100 μm are present. The surfaces of the fibers of the substrate preferably comprise at least in part a structure consisting of elevations which are from 1 nm to 100 μm high on average and spaced apart by 1 nm to 100 μm on average and which are formed by the hydrophobic particles.

Most preferably, the surfaces of the fibers of the substrate according to the present invention comprise structures comprising elevations having an average height in the range from 0.1 to 50 μm, preferably in the range from 0.5 to 5 μm and an average spacing in the range from 0.1 to 50 μm, preferably in the range from 0.5 to 5 μm. Herein, the average spacing of the elevations refers to the distance from the highest elevation of one elevation the highest elevation of the next elevation. When an elevation has the shape of a cone, it is the tip of the cone which is the highest elevation of the elevation. When the elevation is a cuboid, the uppermost surface of the cuboid constitutes the highest elevation of the elevation. The average width of the elevation is preferably in the range from 1 nm to 100 μm, more preferably in the range from 50 nm to 4 μm, and most preferably in the range from 0.3 to 1 μm. The average width of the elevations is measured at half the height of the elevations and is averaged from the smallest and the greatest widths. The average width of a cone or cylinder is thus equal to the diameter of the cylinder or cone at half its height. The average width of a cube is the average from the length of the side surface plus the length of the area diagonals. It is currently believed to be particularly advantageous when the surface of the fibers of the substrate comprises particles which are spaced apart by from 0 to 10, and in particular, from 0 to 3 particle diameters.

The substrate of the present invention preferably has self-cleaning properties. Self-cleaning properties are here defined as substrates of the present invention having a rolloff angle, measured as per Example 11 on a water droplet 60 μl in volume, of less than 20° and preferably less than 10°.

The vapor pervious water impervious substrate of the present invention can be used for example as an industrial textile, as a textile continuous sheet material or as a clothing textile. More particularly, the substrate of the present invention can be an awning, a parasol, a tent material, workwear, leisure wear, sportswear or the inlet or an outerwear fabric, as such or be used for their production.

EXAMPLES

Example 1

A polyethylene terephthalate (PET) web (Freudenberg, FS22325) is roll coated in a continuous process with a sol comprising 5 g of TEOS, 5 g of 5% by weight hydrochloric acid, and 5 g of GLYMO in 90 g of ethanol, the sol having been initially stirred at room temperature for 2 h, at a track speed of 10 m/h, and dried at 150° C. for 30 seconds.

The web thus treated is then coated, on the same apparatus and at the same temperature, with a suspension of 1 g of Aerosil VPLE 8241 in 99 g of ethanol, the ethanol further comprising 0.1 g of GLYMO and 0.1 g of TEOS and also 0.1 g of 5% by weight hydrochloric acid.

Example 2

A PET web (Freudenberg, FS22325) is roll coated in a continuous process with a sol comprising 5 g of TEOS, 5 g of 5% by weight hydrochloric acid, and 5 g of GLYMO in 90 g of ethanol, following stirring at room temperature for 2 h, at a track speed of 10 m/h, and dried at 150° C. for 30 seconds.

This web is then coated, on the same apparatus and at the same temperature, with a suspension of 2.5 g of Aerosil VPLE 8241 in 97.5 g of ethanol, the ethanol further comprising 0.25 g of GLYMO and 0.25 g of TEOS and also 0.25 g of 5% by weight hydrochloric acid.

Example 3

A PET web (Freudenberg, FS22325) is roll coated in a continuous process with a sol comprising 5 g of TEOS, 5 g of 5% by weight HCl and 5 g of GLYMO in 90 g of ethanol, following stirring at room temperature for 2 h, at a track speed of 10 m/h, and dried at 150° C. for 30 seconds.

This web is then coated, on the same apparatus and at the same temperature, with a suspension of 5 g of Aerosil VPLE 8241 in 95 g of ethanol, the ethanol further comprising 0.5 g of GLYMO and 0.5 g of TEOS and also 0.5 g of 5% by weight hydrochloric acid.

Example 4

A polyacrylonitrile (PAN) web (Freudenberg, FS 1773) is roll coated in a continuous process with a sol comprising 5 g of TEOS, 5 g of 5% by weight hydrochloric acid, and 5 g of GLYMO in 90 g of ethanol, following stirring at room temperature for 2 h, at a track speed of 10 m/h, and dried at 150° C. for 30 seconds.

This web is then coated, on the same apparatus and at the same temperature, with a suspension of 2.5 g of Aerosil VPLE in 97.5 g of ethanol, the ethanol further comprising 0.25 g of GLYMO and 0.25 g of TEOS and also 0.25 g of 5% by weight hydrochloric acid.

Example 5

The substrates produced according to Examples 1 to 4 were examined for their self-cleaning properties, their durability and their water imperviousness. In addition, the same investigations were carried out on untreated substrates.

The self-cleaning effect was evaluated by determining the rolloff angle. The smaller the rolloff angle, the better the self-cleaning properties (i.e., the lotus effect). To measure the rolloff angle, the treated substrate was placed on a planar surface which was to be raised on one side. For each test, water droplets 20 μl and 60 μl in volume were pipetted onto the surface of the substrate. The plate was then raised on one side such that an increasing angle resulted when compared with the original position. For each test, the angle with the original, horizontal position was determined at which the water droplets rolled off on their own.

Abrasion resistance was verified when, following a number of cycles of an abrasion test, the tested substrate location was either wetted by water or the water droplets did not run off (even at an angle of 90° with the horizontal). Wetting was defined as an applied water droplet (20 μl) spreading on the surface. The abrasion test was carried out using a rotating round PET web 2 cm in diameter and loaded with a weight of 611 g.

Watertightness was determined by ascertaining at what height of a water column on the substrate water permeation was observed (measured according to DIN EN13562). The PET web and PAN web substrates not coated with hydrophobic particles were unable to support a water column.

| Web of . . . | Rolloff angle[1)] 20 μl/60 μl | Abrasion[2)] Wetting after . . . | Water column cm |
|---|---|---|---|
| PET web | >60°/>60° | — | 0 |
| PAN web | >60°/>60° | — | 0 |
| Example 1 | 11/6 | 30 cycles | 17 |
| Example 2 | 8/6 | 100 cycles | 20 |
| Example 3 | 7/6 | 200 cycles | 15 |
| Example 4 | 5/4 | 50 cycles | 12 |

[1)]of a water droplet,
[2)]wetting of damaged web by water

The experimental results reveal that a material according to Examples 2 and 3 show superior results with regard to durability.

The above written description of the invention provides a manner and process of making and using it such that any person skilled in this art is enabled to make and use the same, this enablement being provided in particular for the subject matter of the appended claims, which make up a part of the original description of the invention.

As used above, the phrases "selected from the group consisting of," "chosen from," and the like include mixtures of specified materials.

All references, patents, applications, tests, standards, documents, publications, brochures, texts, articles, etc. mentioned herein are incorporated herein by reference. Where a numerical range or limit is stated, the endpoints are included. Also, all values and subranges within a numerical limit or range are specifically included as if explicitly written out. Terms such as "contain(s)" and the like as used herein are open terms meaning 'including at least' unless otherwise specifically noted.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

The invention claimed is:

1. A process for producing a vapor-pervious, water-impervious textile substrate, comprising a) treating a substrate with a liquid comprising at least one adhesion promoter to form a liquid treated substrate which, after drying, has fibers coated with a first coating consisting of a hydrolyzed tetraethoxysilane obtained by reacting tetraethoxysilane with an aqueous solution of hydrochloric acid, and at least one first adhesion promoter, wherein the first coating is in direct contact with the fibers and is at least circumferentially continuous; and b) treating the liquid treated substrate from a) with a mixture comprising hydrophobic particles, a solvent, and at least one adhesion promoter to form the vapor-pervious, water-impervious textile substrate having, on the first coating, a second coating comprising the hydrophobic particles having an average particle size in the range from 0.02 to 100 μm, a hydrolyzed tetraethoxysilane obtained by reacting tetraethoxysilane with an aqueous solution of hydrochloric acid, and at least one second adhesion promoter, where the second coating is at least circumferentially continuous; wherein the liquid treated substrate of a) is dried before being treated in b); wherein the mixture treated substrate of b) is dried; and wherein the at least one adhesion promoter in a) and b) may be the same or different.

2. The process according to claim 1, wherein the liquid in a) comprises water, at least one solvent, or a mixture thereof.

3. The process of claim 2, wherein the at least one solvent is selected from the group consisting of alcohols, ethers, esters, ketones, aldehydes, N-methylpyrrolidone, and mixtures thereof.

4. The process of claim 3, wherein the liquid in a) is a solution or a sol, and wherein the adhesion promoter comprises from 0.1% to 10% by weight of an at least one partially hydrolyzed silane.

5. The process of claim 4, wherein the liquid in a) further comprises from 0.1% to 10% by weight of tetraethoxysilane.

6. The process of claim 1, wherein the adhesion promoter in a) comprises 3-aminopropyltriethoxysilane, 2-aminoethyl-3-aminopropyltrimethoxysilane, 3-glycidyloxytrimethoxysilane, 3-methacryloxypropyltrimethoxysilane, vinyltriethoxysilane, vinyltrimethoxysilane, vinyltris(2-methoxyethoxy)silane, or a mixture thereof.

7. The process one of claim 1, wherein the mixture of b) comprises from 0.1% to 5% by weight of hydrophobic particles, at least one alcohol, and from 0.1% to 20% by weight of the at least one adhesion promoter.

8. The process of claim 7, wherein the at least one adhesion promoter of b) comprises trimethylethoxysilane, isobutyltriethoxysilane, octyltriethoxysilane, or a mixture thereof.

9. The process of claim 1, wherein the hydrophobic particles are selected from the group consisting of hydrophobic particles of silicates, hydrophobic particles of minerals, hydrophobic particles of metal oxides, hydrophobic particles of metal powders, precipitated silicas, pyrogenic silicas, pigments, polymers, and combinations thereof.

10. The process of claim 1, wherein the hydrophobic particles comprise a fine structure comprising elevations from 1 to 1000 nm high on average that are spaced apart from 1 to 1000 nm on average.

11. The process of claim 1, wherein the hydrophobic particles are endowed with hydrophobic properties by treatment with at least one compound selected from the group consisting of alkylsilanes, fluoroalkylsilanes, disilazanes, and combinations thereof.

12. The process of claim 1, wherein the solvent in b) comprises ethanol.

13. The process of claim 1, wherein the treating the substrate with the liquid in a), the treating the liquid treated substrate with the mixture in b), or a combination thereof, comprises knife coating, spray coating, roller coating, drenching, dipping, or a combination thereof.

14. The process of claim 1, wherein the drying after a), the drying after b), or a combination thereof, comprises heating the treated substrate to a temperature in the range from 80 to 250° C.

15. The process of claim 1, wherein the substrate comprises a woven fabric, a loop-formingly knit fabric, a felt nonwoven web comprising polymeric fibers, natural fibers, or a combination thereof, a fibrous nonwoven web comprising polymeric fibers, natural fibers, or a combination thereof, or a combination thereof.

16. The vapor-pervious, water-impervious textile substrate produced by the process of claim 1.

17. A vapor-pervious water-impervious textile substrate, comprising fibers, wherein the fibers comprise, on the surfaces of the fibers, a first coating consisting of a hydrolyzed tetraethoxysilane obtained by reacting tetraethoxysilane with an aqueous solution of hydrochloric acid, and at least one first adhesion promoter, wherein the first coating is in direct contact with the fibers and is at least circumferentially continuous, and a second coating comprising hydrophobic particles having an average particle size in the range from 0.02 to 100 μm, the hydrolyzed tetraethoxysilane obtained by reacting tetraethoxysilane with an aqueous solution of hydrochloric acid, and at least one second adhesion promoter, where the second coating is at least circumferentially continuous.

18. The substrate of claim 17, wherein the surfaces of the fibers of the substrate comprise at least one structure comprising elevations which are from 1 nm to 100 μm high on average and spaced apart by 1 nm to 100 μm on average and which are formed by the hydrophobic particles.

19. The substrate of claim 17, wherein the substrate has self-cleaning properties.

20. The substrate of claim 19, wherein the hydrophobic particles comprise silicates, minerals, metal oxides, metal powders, precipitated silicas, pyrogenic silicas, polymers, or combinations thereof.

21. The substrate of claim 19, wherein the hydrophobic particles comprise nanostructured microparticles comprising a fine structure comprising elevations having an aspect ratio of greater than 1.

22. The substrate of claim 17, wherein the substrate comprises a fibrous nonwoven web, a woven fabric, a loop-formingly knit fabric, a felt comprising polymeric fibers, natural fibers, or a combination thereof, a fabric comprising polymeric fibers, natural fibers, or a combination thereof.

23. A method of making an industrial textile, a textile continuous sheet material, or a clothing textile comprising incorporating the vapor-pervious, water-impervious substrate of claim 17 into the industrial textile, the textile continuous sheet material, or the clothing textile.

24. The method of claim 23, wherein the continuous sheet material is an awning, a parasol, a tent material, an inlet or an outerwear fabric.

25. The substrate of claim 17, wherein the first adhesion promoter contains a hydrolyzed silane.

26. The substrate of claim 17, wherein the first adhesion promoter is selected from the group consisting of 3-aminopropyl-triethoxysilane,2-aminoethyl-3-aminopropyltrimethoxysilane, 3-glycidyloxytrimethoxysilane, 3-methacryloxypropyltrimethoxysilane, vinyltrimethoxysilane and vinyltris(2-methoxyethoxy)silane.

27. The substrate of claim 26, wherein the fibers are polymeric fibers.

28. The substrate of claim 17, wherein the fibers are woven to form the textile.

29. The substrate of claim 17, wherein the hydrophobic particles are present on the surface of the fibers.

30. The substrate of claim 17, wherein silanol groups present on the second coating bond the hydrophobic particles to the fibers through hydroxyl groups on the first coating.

31. The substrate of claim 17, wherein the second adhesion promoter is at least one adhesion promoter selected from the group consisting of 3-aminopropyl-triethoxysilane, 2-aminoethyl-3-aminopropyltrimethoxysilane, 3-glycidyloxytrimethoxysilane, 3-methacryloxypropyltrimethoxysilane, vinyltrimethoxysilane and vinyltris(2-methoxyethoxy)silane.

32. The substrate of claim 17, wherein both the first adhesion promoter and the second adhesion promoter are one or more selected from the group consisting of 3-aminopropyltriethoxysilane, 2-aminoethyl-3-aminopropyltrimethoxysilane, 3-glycidyloxytrimethoxysilane, 3-methacryloxypropyltrimethoxysilane, vinyltrimethoxysilane and vinyltris(2-methoxyethoxy)silane.

33. The substrate of claim 17, wherein the second coating is a homogeneous dispersion of at least the hydrophobic particles and the adhesion promoter.

* * * * *